US009007211B1

(12) United States Patent
Leyden

(10) Patent No.: US 9,007,211 B1
(45) Date of Patent: Apr. 14, 2015

(54) TETHERING SYSTEM FOR SECURING PAIRED ARTICLES

(71) Applicant: Se-Kure Controls, Inc., Franklin Park, IL (US)

(72) Inventor: Roger J. Leyden, Inverness, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 0 days.

(21) Appl. No.: 14/499,382

(22) Filed: Sep. 29, 2014

Related U.S. Application Data

(63) Continuation of application No. 14/462,842, filed on Aug. 19, 2014.

(51) Int. Cl.
*G08B 13/14* (2006.01)

(52) U.S. Cl.
CPC ..... *G08B 13/1445* (2013.01)

(58) Field of Classification Search
CPC . G08B 13/2402; G08B 13/2434; G06Q 20/20
USPC ..... 340/568.1, 568.4, 568.6, 572.8, 572.9, 340/571, 686.1, 687, 568.2, 568.8; 70/18, 70/30, 49, 58
See application file for complete search history.

(56) References Cited

U.S. PATENT DOCUMENTS

| | | | | |
|---|---|---|---|---|
| 4,069,919 | A | 1/1978 | Fernbaugh | |
| 5,016,284 | A | 5/1991 | Brown | |
| 5,524,463 | A | 6/1996 | Schenkel et al. | |
| 5,610,587 | A | 3/1997 | Fujiuchi et al. | |
| 5,904,056 | A * | 5/1999 | Ozaki | 70/18 |
| 6,755,055 | B2 * | 6/2004 | Sedon et al. | 70/57.1 |
| 8,368,543 | B2 | 2/2013 | Yang | |
| 2011/0102179 | A1 | 5/2011 | Ezzo et al. | |
| 2013/0098122 | A1 | 4/2013 | Eckert et al. | |

* cited by examiner

*Primary Examiner* — Toan N Pham
(74) *Attorney, Agent, or Firm* — Wood, Phillips, Katz, Clark & Mortimer

(57) ABSTRACT

A tethering system with an elongate cable. A first cable end is configured to be directed through a first article opening. Structure cooperates between the first cable end and a first blocking component and is configured to releasably fix the first cable end to the first blocking component. The first blocking component is configured so that the first blocking component will not pass through the first article opening. Structure cooperates between a second blocking component and cable and is configured to releasably fix the second blocking component to the cable at a location spaced from the first cable end with the cable directed through the second opening. The second blocking component is configured so that it will not pass, together with a portion of the cable to which the second blocking component is fixed, through the second article opening.

23 Claims, 4 Drawing Sheets

TETHERING SYSTEM FOR SECURING PAIRED ARTICLES

CROSS-REFERENCE TO RELATED APPLICATIONS

This application is a continuation of U.S. application Ser. No. 14/462,842 filed Aug. 19, 2014.

BACKGROUND OF THE INVENTION

1. Field of the Invention

This invention relates to tethering systems and, more particularly, to a system for securing articles that are commonly displayed and sold as pairs.

2. Background Art

Securing of portable articles continues to be a challenge worldwide. Theft of small articles becomes even more pervasive as small articles in many categories continue to become more expensive. For example, apparel items, such as shoes, continue to evolve and be made available in more expensive forms.

As shoes become more expensive, purveyors thereof are challenged to allow prospective customers to try the shoes on without significant interference by security components. At the same time, precautionary steps must be taken so that the shoes cannot be removed without detection from establishments at which they are displayed and offered for sale.

Even with less expensive shoe styles that normally do not warrant a significant security investment, progressive, and cumulatively significant, losses may be faced by businesses from other than theft. Typically, all styles of shoes are boxed in pairs and often displayed whereby boxes with many different sizes of shoes may be accessible to a potential consumer. It is not uncommon to see individuals trying on shoes and having multiple boxes opened at the same time so that a user can compare fit of different sizes. If the paired shoes are not attached, inevitably sizes will become mixed when reboxed. Consumers may try on but a single shoe to make a purchasing decision. They may inadvertently pair that shoe with a mismatched size. Alternatively, consumers may actually have different size feet such that they purposefully match shoes of different size for maximum comfort. When the remaining inventory is re-boxed, business operators are left with mismatched pairs that cannot be sold. This may lead to disposal of potentially a large quantity of shoes over an inventory period.

While store personnel are commonly instructed to make certain shoes are properly matched at checkout locations, commonly this practice is not followed. This is particularly a problem at peak checkout times during which personnel may be reluctant to lengthen the checkout process for fear of aggravating the purchasers of the shoes as well as others waiting to check out.

To avoid mismatching and minimize the likelihood of unauthorized removal of shoes from businesses, it is known to incorporate cable-type security systems. One commonly used design employs a flexible metal cable that has at its one end a housing with an electronic article surveillance (EAS) component therein. The other end is designed to be releasably held in that housing to form a closed loop.

To assemble this system, the free end of the cable remote from the housing is directed through at least one eyelet on each of the paired shoes and directed into the housing. Through a conventional clutching arrangement, this press fitting will securely hold the cable end in the housing until it is released by authorized personnel. Typically, the clutch mechanism is released by a magnet that is routinely kept at checkout locations.

The looped cable prevents the shoes from being separated from each other. The length of the cable is ideally selected so that it can be conveniently stored in the typically dimensioned box for the shoes without crowding the box space. At the same time, the cable must be long enough to allow a prospective purchaser to try one or both of the shoes on to sense feel. The length of the cable inevitably becomes long enough that it must be wrapped or folded to be placed back in the box with the shoes. A significant bunching of the cable may detract from the appearance of the shoes as the lid is removed from the box to expose the same. A lengthy cable is also prone to becoming inadvertently knotted and/or entangled with one or both of the associated shoes.

The EAS component is one commonly used in retail establishments that interacts with a detector, typically at exits, to alert store personnel that the articles have moved in a certain manner, i.e., outside of a range, or past a detector, such as at exit locations. In this respect, the conventional security systems have been generally adequate.

However, assembly and disassembly of security systems utilizing tethers can be relatively inconvenient and time-consuming. To operatively set up the security system, the free end of the cable must be directed through eyelets on each of the shoes to allow the cable to be drawn substantially fully therethrough. The free end is then directed into the housing carrying the EAS component to fix the loop. There is a certain level of inconvenience associated with having to draw a relatively long length of the cable through the eyelets. Further, the sliding of the cable through the eyelets could damage the eyelets or produce unsightly marks on the shoes. The same problem is contended with at checkout, where store personnel separate the free end of the cable from the housing and then back the cable out of the shoe eyelets.

Delays at checkout become more significant since consumers may abort a sale if checkout lines and times become too long. Thus, all security systems are designed with the objective of having a minimal time requirement for removal.

While longer cables have certain advantages in terms of allowing the shoes to be separated to a greater degree when a consumer is testing the same, as noted above, a longer length of cable creates a design challenge. That is, the cable must be somehow compacted and pressed into the box with the shoes, preferably so that it does not tangle, do any damage to the shoes, or detract appreciably from the appearance of the shoes when they are boxed. In the case of a straight cable, the selected spacing between the pairs that is permitted effectively requires a relaxed cable length of twice that spacing distance, given the loop construction. This configuration thus creates a particular design challenge.

The above problems persist in the sale of footwear and are also encountered with other categories of goods—apparel and non-apparel. Many industries continues to seek out designs for security systems that allow consumers to make a substantially unencumbered inspection of articles while at the same time affording purveyors of these articles the peace of mind knowing that their goods are displayed in a visually appealing manner and are secured effectively against theft.

SUMMARY OF THE INVENTION

In one form, the invention is directed to the combination of: a) at least one portable article having first and second spaced article openings; and b) a tethering system. The tethering system includes: an elongate cable having a length between first and second ends, with the first end configured to be directed through the first article opening in one direction to an exposed position; and a first blocking component. Structure cooperating between the first cable end and first blocking component is configured to releasably fix the first cable end to the first blocking component. The first blocking component is configured so that the first blocking component will not pass through the first article opening to thereby prevent the first end of the cable with the first blocking component fixed thereto from moving from the exposed position oppositely to the one direction through the first article opening. A second blocking component is provided. Structure cooperating between the second blocking component and cable is configured to releasably fix the second blocking component to the cable at a location spaced from the first cable end with the cable directed through the second opening. The second blocking component is configured so that it will not pass, together with a portion of the cable to which the second blocking component is fixed, through the second article opening in a first direction. A first component is provided on at least one of: a) the first blocking component; b) the second blocking component; c) the cable; and d) another component attached to the cable and is configured to interact with a detection system to provide an indication that the first component has been moved in a certain manner to thereby allow monitoring of the at least one portable article to which the tethering system is operatively connected.

In one form, the structure cooperating between the first cable end and first blocking component consists of an elongate pin at the first cable end and a first clutch assembly within a first locking opening on the first blocking component. The first clutch assembly is configured to fix the first pin within the first locking opening as an incident of the first pin advancing in a first direction into the first locking opening.

In one form, the first clutch assembly is configured to be changed from a locked state, in which the first clutch assembly fixes the first pin in the first locking opening, into a released state as an incident of the first clutch assembly being strategically exposed to a magnetic force.

In one form, the structure cooperating between the second blocking component and cable consists of an elongate pin at the second cable end and a second clutch assembly within a second locking opening on the second blocking component. The second clutch assembly is configured to fix the second pin within the second locking opening as an incident of the second pin advancing in a second direction into the second locking opening.

In one form, the second clutch assembly is configured to be changed from a locked state, in which the second clutch assembly fixes the second pin in the second locking opening, into a released state as an incident of the second clutch assembly being strategically exposed to a magnetic field.

In one form, the first detection component is an electronic article surveillance (EAS) component.

In one form, the first detection component is on the second blocking component.

In one form, the cable has a pre-set coiled portion that is configured to be stretched to change an effective length of the elongate cable.

In one form, the at least one portable article is a pair of footwear pieces. First and second article openings are formed one each on the footwear pieces.

In one form, the first and second article openings are shoelace openings.

In one form, the tethering system is provided in combination with a detection system configured to provide an indication that the first detection component has been moved in a certain manner.

In one form, the detection system includes an alarm that is triggered as an incident of the first detection component moving in the certain manner. The alarm is configured to generate a signal that can be sensed at least one of audibly and visually.

In one form, the invention is directed to a method of securing at least one portable article. The method includes the steps of: providing the combination described above; directing the cable through the first and second article openings; and fixing the cable to the second blocking component such that parts of the at least one portable article reside captively between the first and second blocking components.

In one form, the first and second article openings are respectively on first and second footwear pieces.

In one form, the method further includes the steps of fixing the first cable end to the first blocking component after the cable is directed through the first article opening and fixing the cable to the second blocking component after the cable is directed through the second article opening.

In one form, the method further includes the step of separating the tethering system from the at least one portable article by separating each of the first and second blocking components from the cable.

In one form, the cable has a pre-set coiled configuration between the first and second ends of the cable.

In one form, the invention is directed to a tethering system for at least one portable article as described above.

In one form, the structure cooperating between the first cable end and first blocking component consists of an elongate pin at the first cable end and a first clutch assembly within a first locking opening on the first blocking component. The first clutch assembly is configured to fix the first pin within the first locking opening as an incident of the first pin advancing in a first direction into the first locking opening.

In one form, the structure cooperating between the second blocking component and cable consists of an elongate pin at the second cable end and a second clutch assembly within a second locking opening on the second blocking component. The second clutch assembly is configured to fix the second pin within the second locking opening as an incident of the second pin advancing in a second direction into the second locking opening.

In one form, the invention is directed to the combination of: a) at least one portable article having first and second spaced article openings; and b) a tethering system. The tethering system includes: an elongate cable having a length between first and second ends, with the first end configured to be directed through the first article opening in one direction to an exposed position; and a first blocking component. Structure cooperates between the first cable end and first blocking component to releasably fix the first cable end to the first blocking component. The first blocking component is configured so that the first blocking component will not pass through the first article opening to thereby prevent the first end of the cable with the first blocking component fixed thereto from moving from the exposed position oppositely to the one direction through the first article opening. A second blocking component is fixed to the cable at a location spaced from the first cable end with the cable directed through the second opening. The second blocking component is configured so that it will not pass, together with a portion of the cable to which the second blocking component is fixed, through the second article opening in a first direction.

In one form, the cable has a pre-set coiled portion between the first cable end and the location spaced from the first end that is configured to be stretched to change an effective length of the elongate cable.

In one form, structure cooperates between the second blocking component and cable and is configured to releasably fix the second blocking component to the cable.

DETAILED DESCRIPTION OF THE PREFERRED EMBODIMENT

Figure 1:
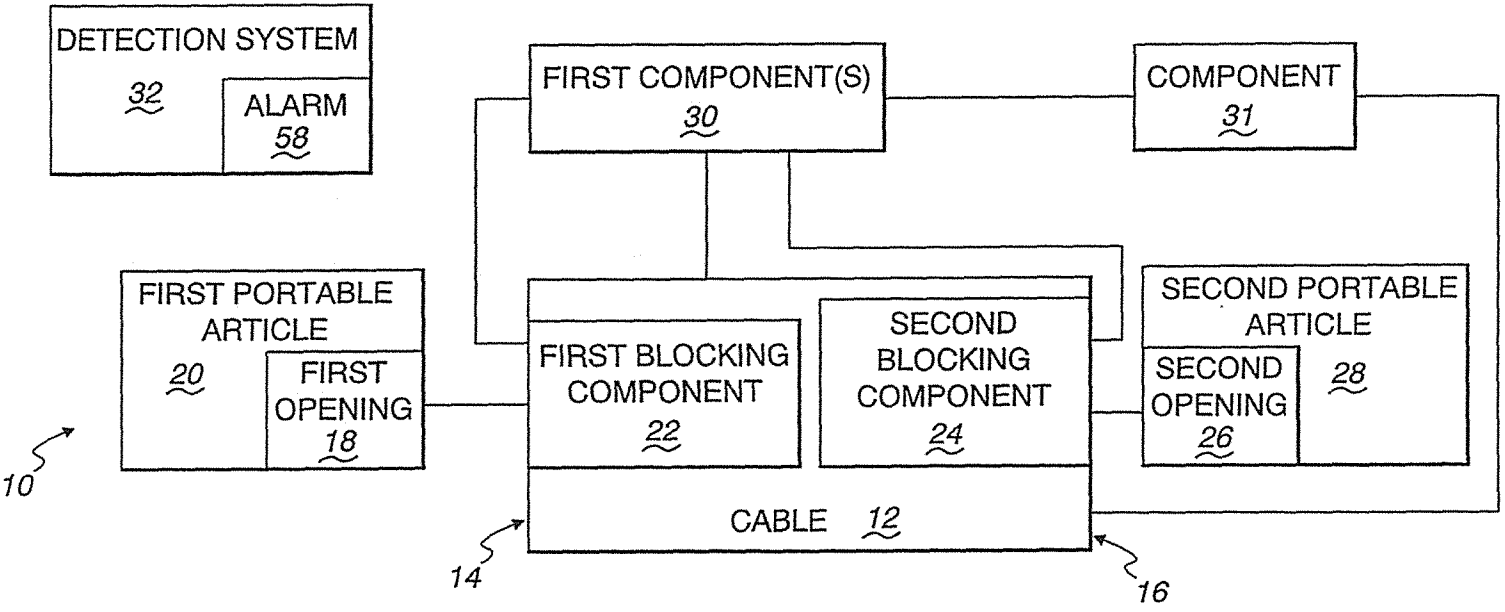
FIG. 1 is a schematic representation of a tethering system, according to the present invention.

In FIG. 1, a schematic representation of a tethering system, according to the present invention, is shown at 10. The tethering system 10 consists of an elongate cable 12 having a length between first and second ends 14, 16, respectively. The first end 14 is configured to be directed through a first opening 18 on a first portable article 20. The first end 14 is directed through the first article opening 18 in one direction to an exposed position.

A first blocking component 22 is releasably fixed to the first cable end 14 in its exposed position. The first blocking component 22 is configured so that it will not pass through the first article opening 18 to thereby prevent the first end 14 of the cable with the first blocking component 22 fixed thereto from moving from the exposed position oppositely to the one direction through the first article opening 18.

A second blocking component 24 is fixed to the cable 12 at a location spaced from the first cable end 14 with the cable 12 directed through a second opening 26 in a second portable article 28. The second blocking component 24 is configured so that it will not pass, together with a portion of the cable 12 to which the second blocking component 24 is fixed, through the second article opening 26 in a first direction.

The schematic showing of components in FIG. 1 is intended to encompass the specific configurations of components, in preferred embodiments hereinafter described, as well as virtually a limitless number of variations thereof that might be devised by one skilled in the art with the inventive teachings in hand. The schematic showing is intended to encompass all of those component variations depicted, and different, relationships therebetween.

For example, the schematic depiction in FIG. 1 is intended to encompass virtually any manner of releasably fixing the first blocking component 22 to the first end 14 of the cable 12. Likewise, the second blocking component 24 may be permanently fixed or releasably fixed to the cable 12 by any suitable structure that cannot be readily tampered with by a would-be thief.

While not required, the tethering system 10 preferably includes at least a first detection component 30 that may be provided on at least one of: a) the first blocking component 22; b) the second blocking component 24; c) the cable 12; and d) another component 31 attached to the cable 12. The detection component 41 is configured to interact with a detection system 32 to provide an indication that the first component 30 has been moved in a certain manner, such as by a detector or beyond a predetermined range. This allows monitoring of the first and second portable articles 20, 28 to which the tethering system 10 is operatively connected.

The first detection component 30 may be any configuration of component that is typically used in electronic article surveillance (EAS) technology. Commonly, the component will be detectable as at an exit location. Myriad types of systems currently exist that could be utilized as part of the invention.

The first and second portable articles 20, 28 may take the form of any portable articles commonly displayed at sales locations and that are vulnerable to theft. So long as the ends 14, 16 of the cable 12 can be directed through pre-formed or formable openings 18, 26, the tethering system 10 is usable and effective.

Figure 3:
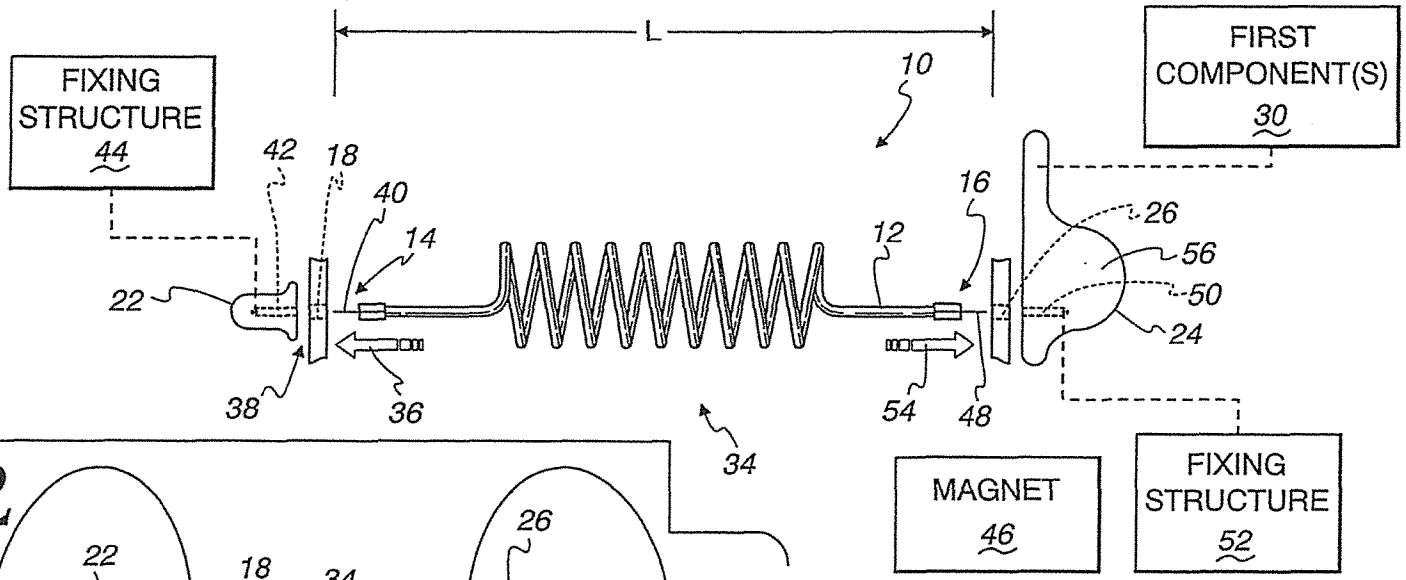
FIG. 3 is a partially schematic, elevation view of the tethering system in FIG. 2 and parts of the shoes with which the tethering system cooperates.
Figure 2:
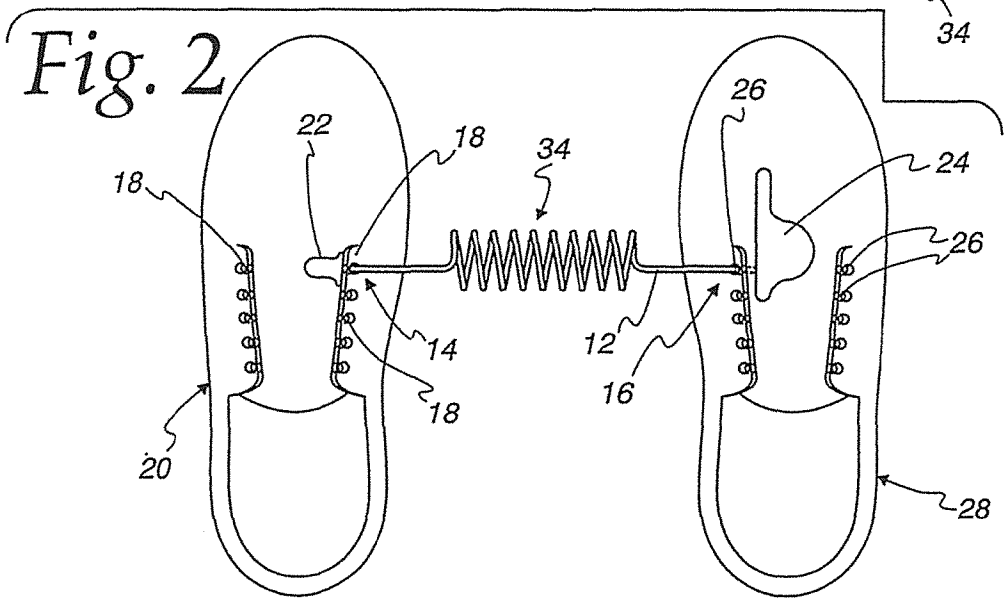
FIG. 2 is a plan view of one form of tethering system, as shown in FIG. 1, operatively connected to separate portable articles, in the form of footwear pieces/shoes.

One specific form of the tethering system 10 is shown in FIGS. 2 and 3, as operatively connected to first and second portable articles 20, 28 in the form of paired footwear/shoes. In this embodiment, the first opening 18 may be any one of the lace openings on the shoe 20. Similarly, the second opening 26 may be any of the lace openings on the shoe 28.

The cable 12 has an effective length L between the first and second ends 14, 16. The cable 12 can have a straight length between the ends 14, 16. Alternatively, and preferably, the cable 12 has a pre-set coiled portion 34 that is configured to be stretched to change/increase an effective length L of the cable 12.

In one exemplary form, the length L with the coiled configuration is on the order of three inches. The length L can be substantially longer if desired. The invention contemplates that a length of less than three inches could be utilized as well.

In one exemplary form, ten to twenty coiled turns might be utilized, with the individual turns having a diameter on the order of ¾ inch. These details, as well as the length L of the cable 12, are merely design considerations and can be varied substantially to meet a user's needs as a particular application dictates.

The first cable end 14 is configured to be directed through the first article opening 18 in one direction, as indicated by the arrow 36 in FIG. 2, to an exposed position in the region at 38. The first blocking component 22 is connected to the exposed portion of the cable end 14.

As noted above, the invention contemplates virtually an unlimited number of different structures that might cooperate between the cable end 14 and first blocking component 22 to releasably fix the first cable end 14 to the first blocking component 22. In this embodiment, the cable 12 has an elongate pin 40 at the end 14 that facilitates direction through the article opening 18 and into the first locking opening 42 on the first blocking component 22. The fixing structure 44 within the first locking opening 42 is preferably configured to fix the pin 40 within the first locking opening 42 as an incident of the first pin advancing in the direction, as indicated by the arrow 36, into the first locking opening 42.

In one preferred form, the fixing structure 44 is in the form of a conventional clutch assembly as disclosed, for example, in U.S. Pat. No. 3,858,280 (Martens); U.S. Pat. No. 5,528,914 (Nguyen et al.); U.S. Pat. No. 5,995,003 (Rogers); U.S. Pat. No. 6,052,876 (Hagan et al.); and U.S. Pat. No. 7,190,272 (Yang et al.), the disclosures of which are incorporated herein by reference. The fixing structure/clutch assembly 44 may take other forms that are purely mechanical or incorporate electronic components, to be released by mechanical components, a magnetic field, an electronic actuator, etc. Regardless of its precise design, the fixing structure/clutch assembly 44 is configured to be selectively changed from a locked state, in which the clutch assembly fixes the pin 40 in the locking opening 42, into a released state. Certain of the conventional clutch assemblies are configured so that they will reconfigure to the released state upon being strategically exposed to a force generated by a magnet 46, as described herein for one exemplary form.

Once the first blocking component 22 is fixed to the cable end 14, it blocks withdrawal of the cable end 14 from the opening 18. The blocking component 22 may take the form depicted or any form that is large enough that it will not pass through the opening 18, thereby to prevent the first end 14 of the cable, with the first blocking component 22 fixed thereto, from moving from its initially exposed position oppositely to the direction indicated by the arrow 36 through the first article opening 18.

The second cable end 16 is provided with a similar elongate pin 48 that is advanced through the second article opening 26 into a second locking opening 50 in the second blocking component 24 where it cooperates with a fixing structure/clutch assembly 52. The structure cooperating between the second blocking component 24 and second cable end 16 may be substantially the same as that cooperating between the first blocking component 22 and cable end 14. That is, the fixing structure/clutch assembly 52 is configured to fix the pin 48 within the second locking opening 50 as an incident of the pin 48 advancing in a direction, as indicated by the arrow 54, into the second locking opening 50. The fixing structure/locking assembly 52 has corresponding locked and released states, with the latter achievable as by using the aforementioned magnet 56.

In this embodiment, the second blocking component 24 is in the form of a housing 56 in which the first detection component 30 resides. The first detection component may be any type of EAS component or other component capable of being detected by a conventional type system that detects movement beyond a particular range or past a certain detection device.

The second blocking component 24 is configured so that it will not pass together with the portion of the cable 12 to which it is fixed through the second article opening 26 oppositely to the assembly direction indicated by the arrow 54.

Accordingly, to operatively connect the tethering system 10, the pin 40 is directed through one of the shoelace openings 18 and fixed to the first blocking component 22. The pin 48 is directed through a second shoelace opening 26 to engage the second blocking component 24. As a result, both footwear pieces/shoes 20, 28 become captive between the blocking components 22, 24 to prohibit separation beyond a distance permitted by the stretched length L of the cable 12. The coiled portion 34 causes the cable 12 to naturally assume a relatively compact length so that it will neatly fit within a conventional shoebox. At the same time, it allows enough lengthwise extension to allow a potential purchaser to try both shoes on and maneuver his/her feet relative to each other to check for fit and comfort.

At a checkout location, the magnet 46 can be used to release both of the blocking components 22, 24 from the cable 12, whereupon the cable can be withdrawn from each of the shoelace openings 18, 26 to be fully separated from the footwear pieces 20, 28. Of course, other systems are contemplated that might allow separation of the blocking components 22, 24 through other means, such as systems operable mechanically and/or electronically.

The aforementioned detection system 32 (FIG. 1) may be configured to provide a signal that can be sensed by store personnel. As one example, the detection system 32 may incorporate an alarm 58 that produces an audible and/or visually detectable breach signal.

Figure 4:
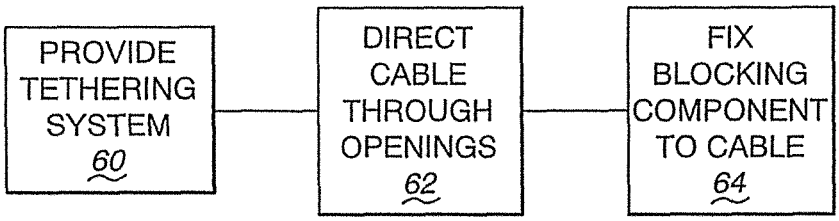
FIG. 4 is a flow diagram representation of a method of securing at least one portable article, according to the invention.

With this basic structure, a method of securing at least one portable article may be performed as shown in flow diagram form in FIG. 4. As shown at block 60, a tethering system is provided.

As shown at block 62, the cable is directed through first and second article openings.

As shown at block 64, the cable is fixed to the second blocking component such that parts of the at least one portable article reside captively between the first and second blocking components.

The FIG. 4 representation is intended to encompass tethering systems wherein only one of the blocking components is releasably fixed to the cable.

Figure 5:
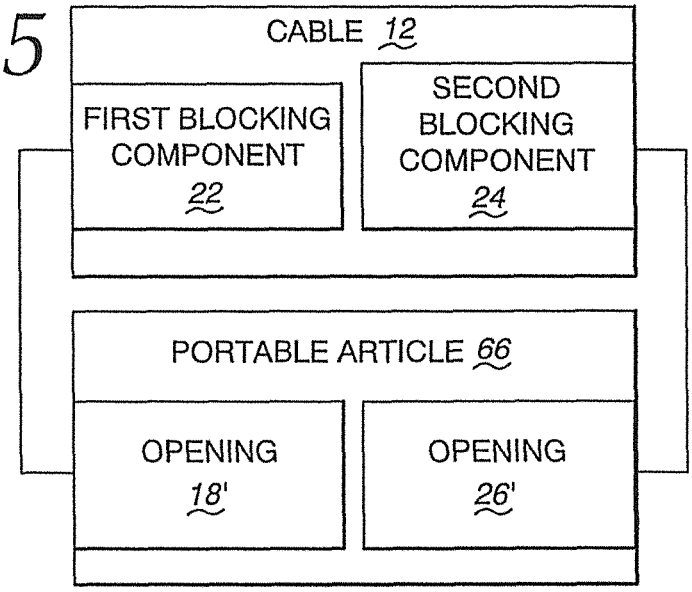
FIG. 5 is a schematic representation of the inventive tethering system operatively connected to a single portable article.

In FIG. 5, a modified combination of components is shown wherein the cable 12 and first and second blocking components 22, 24 are used to operatively connect the cable 12 to a single portable article 66 having article openings 18', 26', corresponding to the earlier described article openings 18, 26. The portable article 66 could take any of numerous different forms, so long as openings 18', 26' are pre-formed or formable to use the tethering system 10 as described above.

Figure 6:
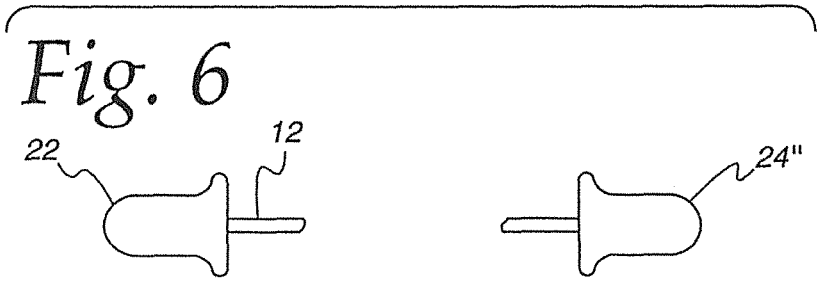
FIG. 6 is a fragmentary, elevation view of a modified form of tethering system that uses only mechanical components.

In FIG. 6, a modified form of tethering system is shown with the cable 12, the aforementioned first blocking component 22, and a modified form of second blocking component 24", that has generally the same configuration as the first blocking component 22. The precise shape of the blocking components 22, 24" is not critical in this embodiment. This embodiment may be purely mechanical and used primarily to maintain two objects, such as footwear pieces, in paired relationship without requiring any electronic monitoring.

Figure 7:
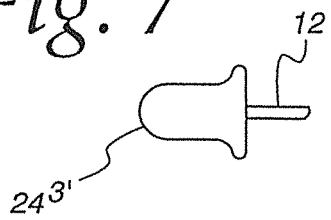
FIG. 7 is a fragmentary view of a modified form of tethering system showing a cable with a permanently fixed blocking component.

In FIG. 7, the cable 12 is shown permanently fixed to a first blocking component 22'''. The other blocking component (not shown) would be releasably fixed to the cable 12 as described above.

Figure 8:
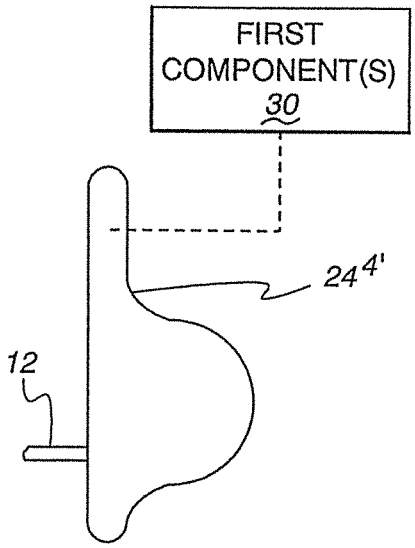
FIG. 8 is a view as in FIG. 7 wherein the permanently fixed blocking component has an associated electronic detection component.

Alternatively, as shown in FIG. 8, the cable 12 might be permanently fixed to the second blocking component 24$^{4'}$, which has the first detection component 30. With this configuration, the cable 12 will be releasably fixed to the other blocking component.

Figure 9:
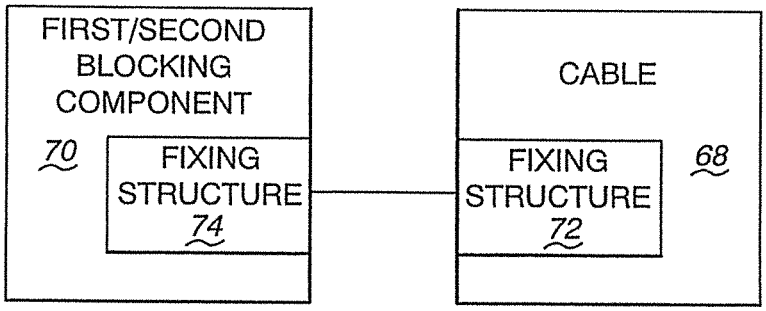
FIG. 9 is a schematic representation of structure cooperating between a cable and a blocking component.

In FIG. 9, there is a schematic depiction of connections between a cable 68, corresponding to the cable 12 described hereinabove and other forms, and blocking components 70 including those described above and others that could be derived therefrom. Fixing structure 72, 74 is provided respectively on the cable 68 and blocking components 70 to releasably connect the same. While the clutching assemblies, described above, represent one preferred form of fixing structure, any structure that can be used to fix the cable to the blocking components is contemplated, so long as it is not readily releasable by an individual without authority to remove the tethering system.

The construction of the cable 12 may vary depending upon the nature of the portable articles being detected. For example, if the article(s) is a high-priced item, the cable might be a hardened metal material with or without a protective coating. For lower-priced items, unhardened metal might be used in solid or braided form. It is conceivable that the cable 12 could be made form a non-metal material, such as plastic or composite.

The foregoing disclosure of specific embodiments is intended to be illustrative of the broad concepts comprehended by the invention.

The invention claimed is:

1. In combination:

a) at least one portable article having first and second spaced article openings; and b) a tethering system comprising:

an elongate cable having a length between first and second ends, the first end configured to be directed through the first article opening in one direction to an exposed position;

a first blocking component;

structure cooperating between the first cable end and first blocking component configured to releasably fix the first cable end to the first blocking component, the first blocking component configured so that the first blocking component will not pass through the first article opening to thereby prevent the first end of the cable with the first blocking component fixed thereto from moving from the exposed position oppositely to the one direction through the first article opening;

a second blocking component;

structure cooperating between the second blocking component and cable configured to releasably fix the second blocking component to the cable at a location spaced from the first cable end with the cable directed through the second opening, the second blocking component configured so that it will not pass, together with a portion of the cable to which the second blocking component is fixed through the second article opening in a first direction; and a first component on at least one of: a) the first blocking component; b) the second blocking component; c) the cable; and d) another component attached to the cable that is configured to interact with a detection system to provide an indication that the first component has been moved in a certain manner to thereby allow monitoring of the at least one portable article to which the tethering system is operatively connected.

2. The combination according to claim 1 wherein the structure cooperating between the first cable end and first blocking component comprises an elongate pin at the first cable end and a first clutch assembly within a first locking opening on the first blocking component, the first clutch assembly configured to fix the first pin within the first locking opening as an incident of the first pin advancing in a first direction into the first locking opening.

3. The combination according to claim 2 wherein the first clutch assembly is configured to be changed from a locked state, in which the first clutch assembly fixes the first pin in the first locking opening, into a released state as an incident of the first clutch assembly being strategically exposed to a magnetic force.

4. The combination according to claim 2 wherein the structure cooperating between the second blocking component and cable comprises an elongate pin at the second cable end and a second clutch assembly within a second locking opening on the second blocking component, the second clutch assembly configured to fix the second pin within the second locking opening as an incident of the second pin advancing in a second direction into the second locking opening.

5. The combination according to claim 4 wherein the second clutch assembly is configured to be changed from a locked state, in which the second clutch assembly fixes the second pin in the second locking opening, into a released state as an incident of the second clutch assembly being strategically exposed to a magnetic field.

6. The combination according to claim 4 wherein the first detection component is on the second blocking component.

7. The combination according to claim 1 wherein the first detection component is an electronic article surveillance (EAS) component.

8. The combination according to claim 1 wherein the cable has a pre-set coiled portion that is configured to be stretched to change an effective length of the elongate cable.

9. The combination according to claim 1 wherein the at least one portable article is a pair of footwear pieces, the first and second article openings formed one each on the footwear pieces.

10. The combination according to claim 9 wherein the first and second article openings are shoelace openings.

11. The combination according to claim 1 further in combination with a detection system configured to provide an indication that the first detection component has been moved in a certain manner.

12. The combination according to claim 11 wherein the detection system comprises an alarm that is triggered as an incident of the first detection component moving in the certain manner, the alarm configured to generate a signal that can be sensed at least one of audibly and visually.

13. A method of securing at least one portable article, the method comprising the steps of:

providing the combination of claim 1;

directing the cable through the first and second article openings; and fixing the cable to the second blocking component such that parts of the at least one portable article reside captively between the first and second blocking components.

14. The method of securing at least one portable article according to claim 13 wherein the first and second article openings are respectively on first and second footwear pieces.

15. The method of securing at least one portable article according to claim 13 further comprising the steps of fixing the first cable end to the first blocking component after the cable is directed through the first article opening and fixing the cable to the second blocking component after the cable is directed through the second article opening.

16. The method of securing at least one portable article according to claim 13 further comprising the step of separating the tethering system from the at least one portable article by separating each of the first and second blocking components from the cable.

17. The method of securing at least one portable article according to claim 14 wherein the cable has a pre-set coiled configuration between the first and second ends of the cable.

18. The tethering system for at least one portable article as recited in claim 1.

19. The tethering system according to claim 18 wherein the structure cooperating between the first cable end and first blocking component comprises an elongate pin at the first cable end and a first clutch assembly within a first locking opening on the first blocking component, the first clutch assembly configured to fix the first pin within the first locking opening as an incident of the first pin advancing in a first direction into the first locking opening.

20. The tethering system according to claim 19 wherein the structure cooperating between the second blocking component and cable comprises an elongate pin at the second cable end and a second clutch assembly within a second locking opening on the second blocking component, the second clutch assembly configured to fix the second pin within the second locking opening as an incident of the second pin advancing in a second direction into the second locking opening.

21. In combination:

a) at least one portable article having first and second spaced article openings; and b) a tethering system comprising:

an elongate cable having a length between first and second ends, the first end configured to be directed through the first article opening in one direction to an exposed position;

a first blocking component;

structure cooperating between the first cable end and first blocking component to releasably fix the first cable end to the first blocking component, the first blocking component configured so that the first blocking component will not pass through the first article opening to thereby prevent the first end of the cable with the first blocking component fixed thereto from moving from the exposed position oppositely to the one direction through the first article opening; and a second blocking component fixed to the cable at a location spaced from the first cable end with the cable directed through the second opening;

the second blocking component configured so that it will not pass, together with a portion of the cable to which the second blocking component is fixed, through the second article opening in a first direction.

22. The combination according to claim 21 wherein the cable has a pre-set coiled portion between the first cable end and the location spaced from the first end that is configured to be stretched to change an effective length of the elongate cable.

23. The combination according to claim 22 wherein structure cooperates between the second blocking component and cable and is configured to releasably fix the second blocking component to the cable.

* * * * *